United States Patent [19]

Miles et al.

[11] 4,084,855

[45] Apr. 18, 1978

[54] WATER-DRIVEN AIR PUMPING AND DUST-SUPPRESSING APPARATUS

[75] Inventors: Roscoe C. Miles, Franklin Township, Westmoreland County, Pa.; Joseph Subrick, Gary, W. Va.; Woods G. Talman, Upper St. Clair Township, Allegheny County, Pa.

[73] Assignee: United States Steel Corporation, Pittsburgh, Pa.

[21] Appl. No.: 644,251

[22] Filed: Dec. 24, 1975

[51] Int. Cl.[2] ..... E21C 7/08

[52] U.S. Cl. ..... 299/64; 299/12; 299/81; 239/428.5; 417/196

[58] Field of Search ..... 299/12, 17, 81, 64; 239/428.5; 417/196

[56] References Cited

U.S. PATENT DOCUMENTS

| | | | |
|---|---|---|---|
| 1,503,870 | 8/1924 | Ball et al. | 299/12 X |
| 2,061,032 | 11/1936 | Hutt | 417/196 |
| 2,268,656 | 1/1942 | Haltmeier | 417/176 |
| 2,283,907 | 5/1942 | Berman | 417/196 |
| 2,632,597 | 3/1953 | Boeckeler | 417/196 |
| 3,625,820 | 12/1971 | Gluntz | 417/196 UX |
| 3,843,199 | 10/1974 | Nash et al. | 299/81 |
| 3,897,110 | 7/1975 | Agnew | 299/81 |
| 3,918,647 | 11/1975 | Lamz | 239/428.5 |
| 3,954,302 | 5/1976 | Browning | 299/81 |
| 3,964,246 | 9/1975 | Gandy et al. | 299/81 |
| 4,010,902 | 3/1977 | Speyer | 239/428.5 |

FOREIGN PATENT DOCUMENTS

| | | | |
|---|---|---|---|
| 2,031,776 | 1/1971 | Germany | 417/196 |

*Primary Examiner*—Ernest R. Purser
*Assistant Examiner*—William F. Pate, III
*Attorney, Agent, or Firm*—William A. Danchuk

[57] ABSTRACT

Fluid-driven air-pumping and mixing apparatus for pumping air into a high methane environment and mixing ambient airborne impurities with such fluid for diluting the same. The apparatus includes a divergent mixing chamber proximate the outlet of the apparatus and a fluid dispersing nozzle having a configuration and location relative to the mixing chamber for maximizing air flow through the apparatus as well as providing a subsidiary advantage of increasing mixing of the driving fluid with the airborne impurities.

10 Claims, 11 Drawing Figures

WATER-DRIVEN AIR PUMPING AND DUST-SUPPRESSING APPARATUS

BACKGROUND OF THE INVENTION

In underground mining in general, and in underground coal mining specifically, dust suppression and methane dilution are required for the safety and health of mine personnel. Both state and federal regulatory agencies have required, and will continue to stringently require the observance of regulations designed to insure the safety and health of such personnel. Accordingly, any change in machinery or method of operation related to dust suppression or methane dilution will be subjected to even more exacting tests.

The problems associated with methane and dust in coal mines have, in some cases, necessitated that otherwise profitable and productive working sections of mines be, at least temporarily, closed. Solutions to these problems have been attempted before with limited success. Although large volumes of air are circulated throughout coal mines, there still exists the possibility that, at the working faces while machines are mining the coal, that pockets or corners exist which have relatively still air. If the coal mine is troubled with methane liberation through the coal seam, these pockets or corners can hold sufficient quantities of methane and coal dust to provide an ignitable mixture. An obvious answer to this problem is to blow air into these pockets and dilute the concentration of methane and coal dust to safe levels.

While the solution is easily stated, it is not easily implemented. The primary problem is in finding a suitable blower or blowers that can be mounted at the front end of a coal mining machine and which can be operated safety and efficiently in a cramped and spacially depleted environment.

Water-powered venturis have been used in the past for the suppression of dust. These designs, while sufficient for their specifically contemplated operation, do not operate as air pumps for methane dilution. It should be obvious that in cramped quarters, a redundancy of machinery is not desirable.

SUMMARY OF THE INVENTION

The present invention is addressed to a water driven air-pumping apparatus for both pumping air into pocketed locations for the dilution of methane and the like which has accumulated therein and for diluting airborne dust and impurities with the water used to drive the air-pumping apparatus.

The air-pumping apparatus, in its fundamental form, utilizes the basic concept of a venturi to accomplish the air-pumping function. A nozzle is positioned within a portion of the apparatus to provide the necessary driving force to power the air pump. The nozzle is configured to disperse the water in a solid cone which has a geometrically similar shape to the divergent section of the venturi movement. The nozzle has an angle of water dispersion greater than the angle of divergence of the divergent exit section of the venturi.

The nozzle is preferably mounted within the apparatus along the latter's longitudinal axis in such a manner that the divergent solid cone of water impinges upon the divergent venturi section no further back than the beginning of divergence of that section. Configured as such, the apparatus provides for maximized air flow through the apparatus along with an ancillary increase in the mixing of the dust contained and carried in the air being pumped with the water being atomized in the divergent mixing chamber of the apparatus. Additionally, the apparatus provides for the cooling of the mining machine bits as well as for the quenching of sparks emitted by the bits during the mining operation.

The specific configuration of the apparatus, and especially the divergent mixing chamber, is dependent upon many factors including space limitations, water pressure, the water nozzle configuration and air inlet conditions. Although the design of a water-powered venturi air pump might appear quite simple, the optimization of such a design for the variety of factors noted above is not.

It is, therefore, a primary object and feature of the present invention to provide a fluid powered air-pumping apparatus which both pumps air and provides for the mixing and abatement of dust and impurities in the air with the driving fluid.

It is a further primary object and feature of the present invention to provide, in combination with an underground mining machine, a water driven air-pumping apparatus mounted on the machine, the apparatus being operative to pump air into pockets of gas or the like released by the mining machine during the mining operation as well as suppressing dust caused as a result thereof.

It is a further primary object and feature of the present invention to provide a third-powered air pumping apparatus which is effective in pumping air to dilute methane and dust made airborne during mining, abating such dust by delivering the driving fluid in fine droplets to the points where the dust is emitted, and cooling the machine bits and quenching sparks occasioned by the cutting bits striking hard rocks above or intruding into the coal seam.

It is a general feature and object of the present invention to provide a water driven air-pumping venturi apparatus for both pumping air therethrough as well as suppressing dust, the apparatus including a solid cone water nozzle strategically locating on the longitudinal axis of the apparatus relative to a divergent exit portion of the venturi apparatus such that the outer portion of the solid cone of water impinges upon the divergent exit portion of the apparatus, the nozzle having an angle of diversion for the solid cone of water greater than the angle of divergence of the divergent exit portion of the venturi apparatus, thereby maximizing air flow through the air-pumping apparatus as well as increasing the mixing of dust with the water used to drive the apparatus.

Other object and features of the invention will, in part, be obvious and will, in part, become apparent as the following description proceeds. The features of novelty which characterize the invention will be pointed out with particularity in the claims annexed to and forming part of the specification.

BRIEF DESCRIPTION OF THE DRAWINGS

The novel features which are considered characteristic of the invention are set forth with particularity in the appended claims. The invention itself, however, both as to its structure and its operation together with the additional objects and advantages thereof will best be understood from the following description of the preferred embodiment of the invention when read in conjunction with the accompanying drawings wherein:

DETAILED DESCRIPTION OF THE INVENTION

Figure 1:
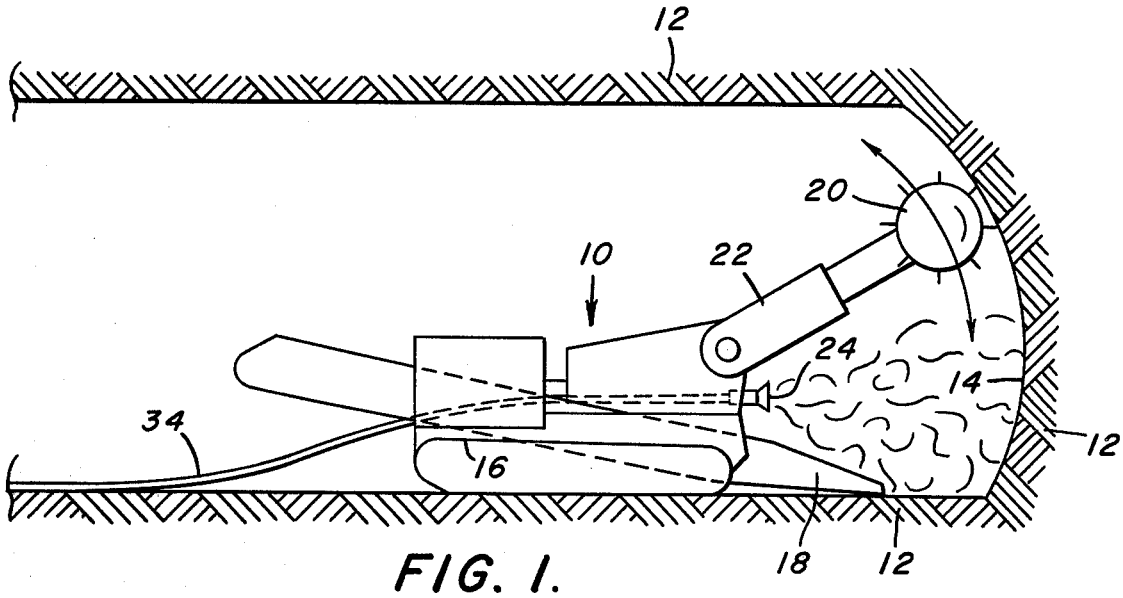
FIG. 1 is an elevational view of the air-pumping apparatus according to the present invention located on an underground mining machine, the latter being in its operative position within an underground mine.

Referring to FIG. 1, there is shown an air-pumping apparatus according to the present invention mounted upon an underground coal mining machine. As will be seen, the present air-pumping apparatus has especial applicability in the coal mining industry inasmuch as methane, an explosive gas, and coal dust in ignitable sizes, are liberated during the mining operation. The underground coal mining machine, shown generally at 10, is employed for both digging the coal 12 from the front face 14 of a tunnel and for scooping the loose coal up and conveying it rearwardly to a convenient point where it may be picked up by a tram. In order to accomplish these functions the mining machine 10 includes crawler treads 16, a scoop 18 and a rotating claw mechanism 20 mounted to the miner 10 through a support arm 22. The arm 22 is mounted to the main section of miner 10 and is movable in both horizontal and vertical directions for the complete mining of a coal seam. The coal which has been dislodged by the claw mechanism 20 is gathered on the scoop and transported rearwardly along a conveyor apparatus (not shown).

Mounted proximate the front of the miner 10 is an air-pumping apparatus 24. Only one apparatus has been shown in the figure due to space limitations. However, it should be noted that a plurality of such devices may be mounted to the miner for the variety of functions such devices are capable of performing. For most purposes, however, all of such devices should be directed so that the air pumped therethrough is aimed toward some portion of the front face 14. It is at the front wall 14 that the buildup of methane liberated in the mining operation may occur. It should be obvious that the claw mechanism 20 of the miner 10 creates enough sparking to ignite sufficiently built-up methane pockets located proximate the front wall. While such explosions might be contained within the localized area of mining through the use of rock dust, they are potentially lethal and remain a dangerous problem in need of rectification.

Efforts, which have been employed in the past, to dilute methane in coal mines have been directed to the use of large diameter piping and wind screening for selectively channeling fresh air to the mine face. Such systems, which include diffuser fans, are generally too noisy to meet current MESA standards, are cumbersome, and utilize generally large amounts of electricity. It should be apparent, after considering the number of methane explosions that occur in mines, that such ventilation systems have not been very successful. Moreover, the continuing dust problems in mines, and coal mines in particular, has led to this development of a highly efficient venturi based air pump and dust suppressor apparatus.

Figure 2:
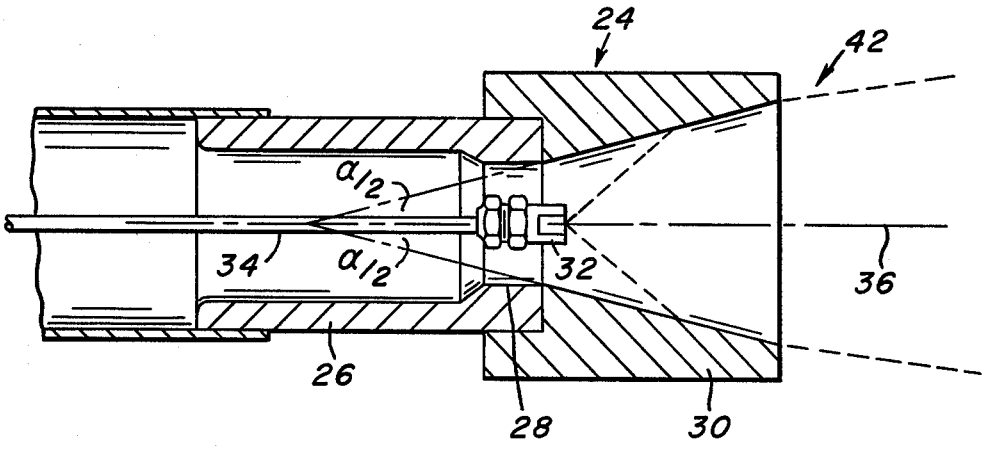
FIG. 2 is a schematic sectional view of one embodiment of the air-pumping apparatus according to the present invention.

Looking to FIG. 2, there is shown a schematic representation of a water driven venturi air pump and dust suppressor according to the present invention. The specific embodiment shown in FIG. 8, and the preferred embodiment indicated in FIGS. 9*a* and 9*b* will be described in further detail below. However, as shown in FIG. 2, the air pump and dust suppressor apparatus configured having an air inlet portion 26, a throat portion 28 and a venturi cone section 30. Positioned within the apparatus and along the longitudinal axis or center line 36 thereof is a spray nozzle 32. The spray nozzle 32 is connected to a pressurized water supply (not shown) through a connecting hose or flexible piping 34. As will be indicated in more explanatory detail below, the divergent portion 30 of the apparatus is by far the most important element of the three sections 26, 28 and 30. It should become apparent that there is a large number of variables which can be defined relative to the optimum design of a water-powered air-pumping and dust suppressing apparatus generally shown in FIG. 2. However, it was found that many of the variables could be dismissed leaving only a few parameters which are of prime consideration. These are: (1) the water spray configuration, (2) the location of the spray nozzle within the apparatus, (3) the angle of divergence $\alpha$ of the venturi cone section, (4) water pressure, and (5) air-inlet configuration.

Figure 3A:
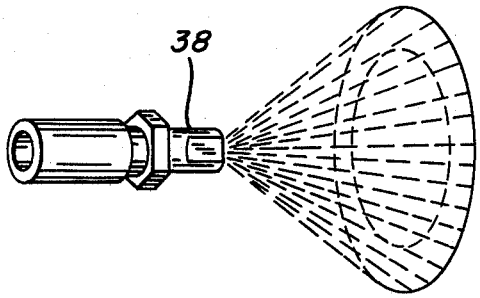
FIG. 3*a* is an artistic rendition of a hollow cone spray nozzle.
Figure 3B:
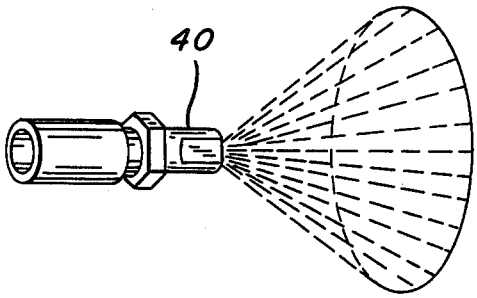
FIG. 3*b* is an artistic rendition of a solid cone spray nozzle associated with the present air-pumping apparatus.

In order to evaluate the above-noted variables, a test fixture incorporating a venturi similar to that shown in FIG. 2 was fabricated. The fixture shown provides for the location adjustment of the spray nozzle in and out of the venturi along the longitudinal axis 36. The fixture is also adapted to accept divergent venturi cones of varying angles of divergence $\alpha$. During evaluation of the above-noted parameters, the venturi throat was fixed at 2 inches and the venturi cone per se was angularly varied by angles of 0°, 4°, 8°, 12°, 16°, 20°, 24°, 28° and 36°. Moreover, water pressure was variable up to rates of 2 gallons per minute with pressures up to 300 psi. Also, both hollow cone as well as solid cone spray nozzles, as shown in FIGS. 3*a* and 3*b*, respectively, were employed at various water flow rates and pressures. The various instruments used for measurements are commonly available in the field and will not be discussed here.

The first test made compared the air-pumping effectiveness of full- versus hollow-cone nozzles. The two nozzles used were similar in capacity rating, i.e., the hollow-cone nozzle 38 had a 0.95 gallons per minute rating at 100 psi while the full-cone nozzle was rated at 0.88 gallons per minute at the same pressure. The nozzles were located within the air-pumping apparatus 24 to impinge on the venturi-cone section 30 at the same location, i.e., 4 inches of center-line distance measure backwardly from the outlet end 42 of the venturi cone 30. A venturi cone with an angle of 20° was used in each case. Readings of the volume of air pumped through the testing apparatus were taken for both nozzles 38 and 40 at water pressures of 150 and 300 psi.

Figure 4:
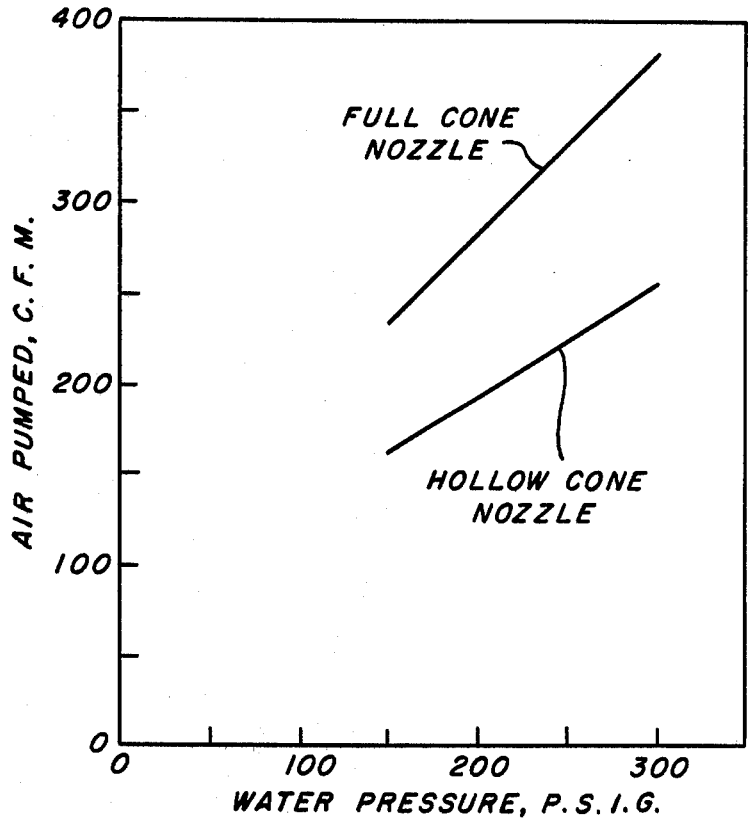
FIG. 4 is a graphic comparison of pumping efficiency of both full-cone and hollow-cone sprays.

The results of the test may be evidenced by referring to FIG. 4. As indicated therein, the full-cone nozzle 40 provides for more air pumping than does the hollow-cone nozzle for both test pressures, i.e., 150 and 300 psi. Moreover, the air-pumping efficiency of the full-cone nozzle increases with an increase in the water pressure, thereby indicating the desirability of employing a solid-cone spray nozzle rather than a hollow-cone nozzle.

Figure 5:
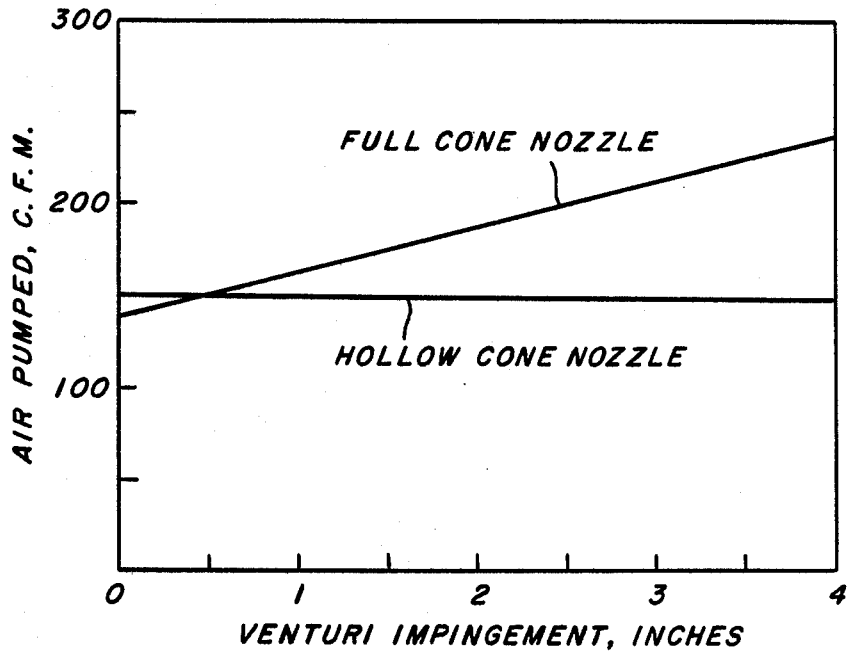
FIG. 5 is a graphic comparison of impingement points of both the solid-cone and hollow-cone spray nozzles with the air-pumping apparatus.

A second test was made to evaluate the effect upon air pumping exerted by changing the point of impingement of the spray configuration on the venturi between the throat and the outlet end of the venturi. For purposes of testing, the nozzles were used with water pressure of 150 psi and a venturi-cone angle of 20°. In all cases, the venturi impingement is measured along the center line from the outlet of the venturi. The results of the test, shown in FIG. 5 as a graph, indicate that, for almost all instances of venturi impingement, use of the full-cone spray nozzle results in greater amounts of air being pumped through the apparatus. In addition, the results also indicate a change in impingement has a definite effect upon the air pumped with a solid-cone spray nozzle, while little effect is realized when a hollow-cone spray nozzle is employed.

Figure 6:
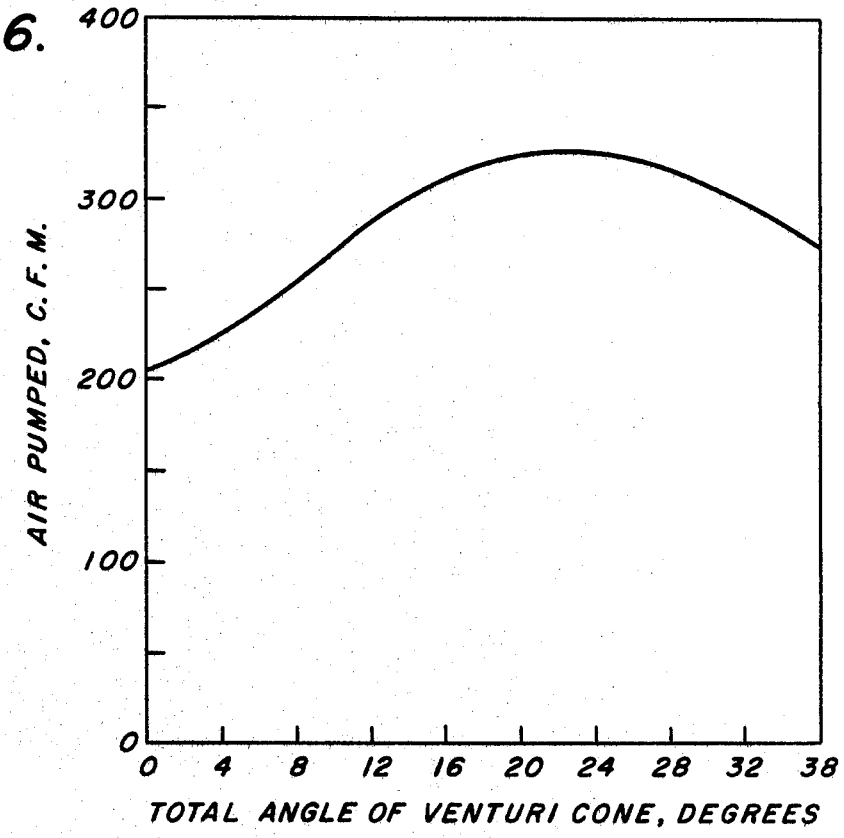
FIG. 6 is a graphic comparison of the effect of angularly changing the exit configuration of one embodiment of the air-pumping apparatus to the amount of air pumped therethrough.

The graph shown in FIG. 6 compares the amount of air pumped through the apparatus as a function of the total venturi-cone angle, with a constant water pressure of 150 psi and a given impingement length of 4 inches. The resultant curve indicates that air pumping is maximized, all other conditions being constant, for venturi-cone angles in the range between 16° and 28°. Although the curve indicates a peak of 320 cfm of air pumped at 22°, the difference was generally not significant enough to automatically preclude the middle range of angles. Moreover, should space become a primary consideration, the venturi-cone diameter should be kept as small as possible, thereby weighting the selection toward the lower portion of the range, i.e., between 16° and 20°. The spray pattern outside the venturi cone will follow the cone angle closely for several feet and then narrow somewhat because of a lowering of pressure inside the spray configuration. Also, in some design applications, a wider angle may be chosen so as to obtain a wider coverage at the coal face, even though this results in lower air pressure per unit area of face.

While providing for the efficient pumping of air to the coal face, the water-powered venturi generally described above also operates as an excellent dust suppressor. One reason for this is that the movement of the air within the venturi helps to further atomize the water spray and then propel it at greater pressures than in the situation in which the spray nozzle is used alone. In some instances, where dust suppression is of primary importance and moderate pressure is needed at the mining face, a water-powered venturi with zero impingment proves more effective. In fact, dust suppressors are configured in exactly that manner, i.e., with no impingement on the venturi-cone section.

Figure 8:
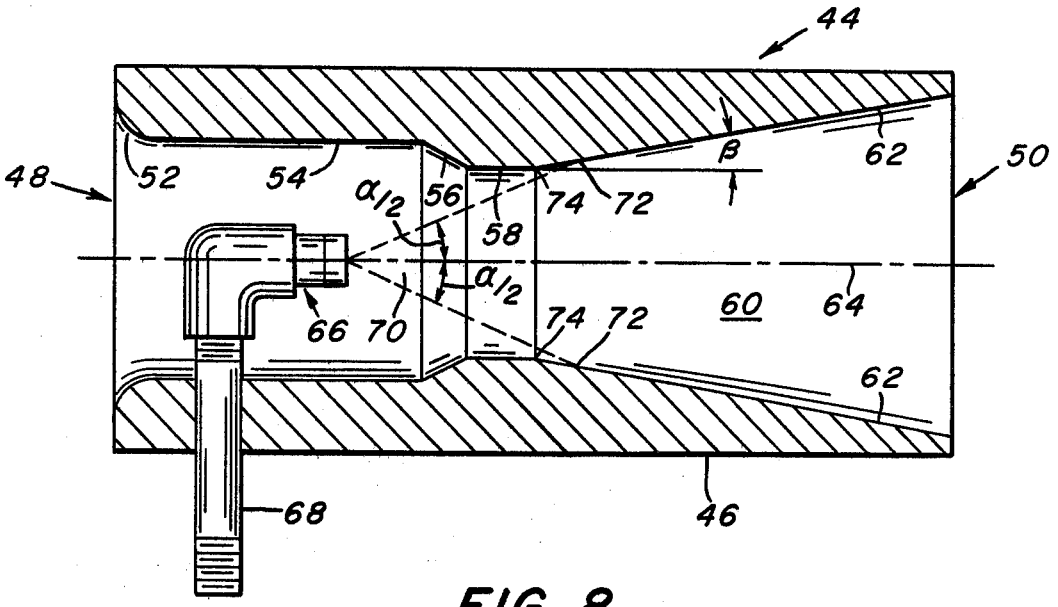
FIG. 8 is a sectioned elevational view of one embodiment of the air-pumping apparatus according to the present invention.

The information gleaned from the tests described above has been employed to aid in the design of several embodiments of a water-powered air-pumping apparatus which both pumps air toward the coal face as well as aids in the suppression of coal dust and the like in the coal mine. One embodiment of an optimized water-powered air-pumping apparatus is shown in FIG. 8. The design shown therein is, in effect, based upon the results of the studies just enumerated. Moreover, testings have indicated that this design produces between 300 and 350 cfm of air with only a 150 psi water rating.

The air-pumping apparatus shown generally at 44 includes a hollow housing 46, adapted to be mounted upon a mining machine, having an inlet end 48 and an exit end 50. The inlet end is shown having a flared inlet portion 52 which promotes the entrance of air and dust into the air-pumping apparatus. The inlet portion is configured having parallel inner wall portions 54 and a converging wall portion 56. Located intermediate the inlet 48 and outlet 50 is a throat portion 58 having a parallel wall configuration. Positioned downstream of the throat portion 58 is a diverging walled chamber 60 which is a mixing chamber for air, water and dust. The chamber 60 is formed by a diverging wall portion 62. The air-pumping apparatus 44 has a circular cross-sectional shape along its entire length when such cross section is taken through a plane normal to the longitudinal axis 64 or center line of the apparatus.

A spray nozzle 66 is positioned as shown and is supplied with water under pressure through appropriate plumbing indicated at 68. Spray nozzle 66 is located proximate the inlet portion of the air-pumping apparatus such that the spray nozzle opening is on the longitudinal axis of the apparatus. Moreover, the nozzle is configured having a diverging spray configuration shown generally at 70. The nozzle 66 is positioned along the longitudinal axis such that the diverging spray 70, having an angle of divergence $\alpha$, begins to impinge upon the diverging wall portion 62 at a point 72 which is proximate the beginning of divergence of the wall portion 62 as at point 74. The point of impingement 72 is preferably located very close to the point of beginning divergence. However, the point 72 should not be located any further back stream (such as within the throat portion 58) than point 74 in order to preserve optimized air flow.

It should also be carefully noted that the angle of divergence of the divergent wall portion 62 of the mixing chamber 60 is $\beta$. The testing done within the test venturi indicated that $2\beta$ was within the range between 16° and 28°. Therefore, the angle $\beta$ in FIG. 8 is approximately 22° and the angle of spray divergence $\alpha$ is approximately 45° to 50° or twice that of the divergent angle $2\beta$ of the mixing chamber. As a result of the above-noted configuration, maximum air is pumped through the apparatus 44 toward the coal face where the air is instrumental in diluting the dangerous methane concentrations previously discussed. Moreover, the configurations of the spray nozzle and divergent mixing chamber promote the atomization of the driving water for the air pump, thereby increasing the mixing of dust in the air with the atomized water.

Figure 9A:
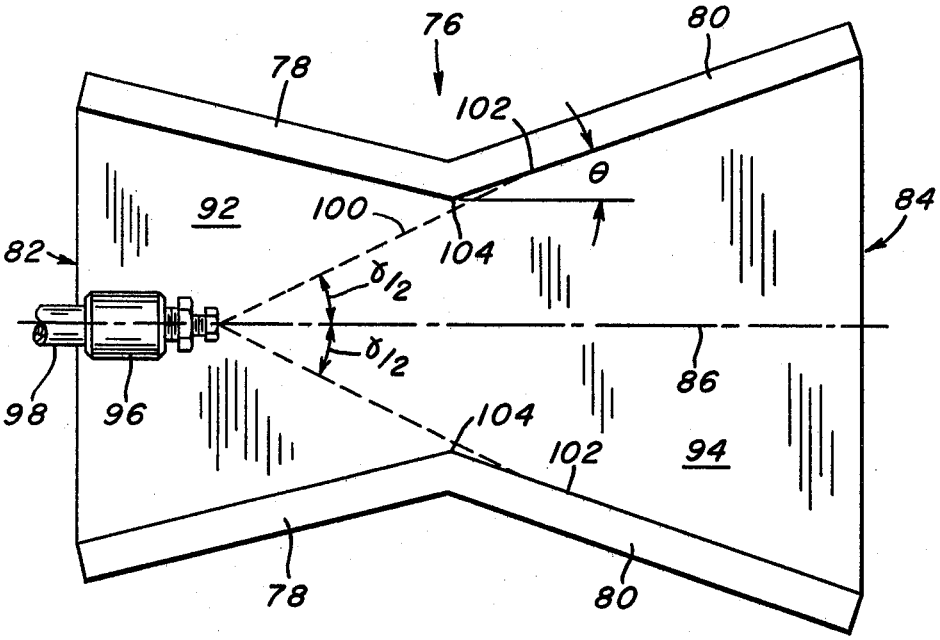
FIG. 9*a* is a sectioned elevational view of a preferred embodiment of the air-pumping apparatus according to the present invention.
Figure 9B:
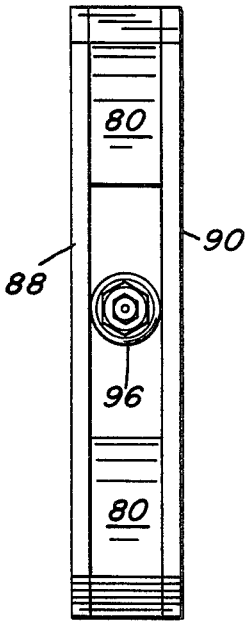
FIG. 9*b* is a front elevational view of the air-pumping apparatus shown in FIG. 9*a*.

Another embodiment of the present invention is shown in FIGS. 9*a* and 9*b*. As may be evidenced from FIG. 9*b*, this embodiment has a rectangularly shaped outlet and housing and has its greatest applicability in cramped space quarters such as are found in shallow seam coal mines. The air pumping apparatus 76 generally includes two converging wall portions 78 and two diverging wall portions 80. Located at the wide ends of wall portions 78 and 80, respectively, are an inlet 82 and an outlet 84. Wall portions 78 and 80 are formed as the shortened walls of a housing having an hourglass configuration with a rectangular cross section when the section is taken through a plane normal to a longitudinal axis or center line 86 of the housing. The remaining lengthened wall portions of the "rectangle" are walls 88 and 90, as shown in FIG. 9*b*. Positioned within the converging chamber 92 formed by the wall portions 78 and directed toward the diverging chamber 94 and formed as a mixing chamber is a spray nozzle 96. The spray nozzle 96 is fed pressurized water through appropriate piping 98 or the like. Nozzle 96, in much the same manner as nozzle 66 in FIG. 8, sprays a divergent solid cone of water 100 toward the outlet 84. Nozzle 96 has an angle of dispersion $\gamma$ which is greater than the angle $2\theta$ of divergence of the wall portions 80. Again in similar fashion to nozzle 66, the nozzle is located along the longitudinal axis 86 such that the diverging solid cone of water impinges on the diverging wall portions 80 at points 102 which are not upstream from the beginning point of divergence 104 of the wall portions 80. The specific angles of divergence $\gamma$ and $2\theta$ for the nozzle spray and divergence of the wall portion 80 was empirically derived in the same testing manner described previously. In this case a given water pressure of 150 psi was used with a given sized "throat" dimension of 3½ inches by 1 inch. The nozzle used in testing, as well as in the preferred embodiment just described, produced a solid cone of water which has a generally geometrically similar rectangular shape as the apparatus itself. The nozzle in effect produces a solid cone of water having a rectangular cross section when the section is taken through a plane normal to the longitudinal axis 86 of the nozzle and the apparatus. Thus, the solid cone of water impinges angularly primarily along the divergent wall portions 80 and does not appreciably diverge with regard to the parallel wall portions 88 and 90. While most of the nozzle divergence has its effect upon the short wall portions 80, it is desirable to retain minimal amounts of water divergence along the parallel wall portions.

Figure 7:
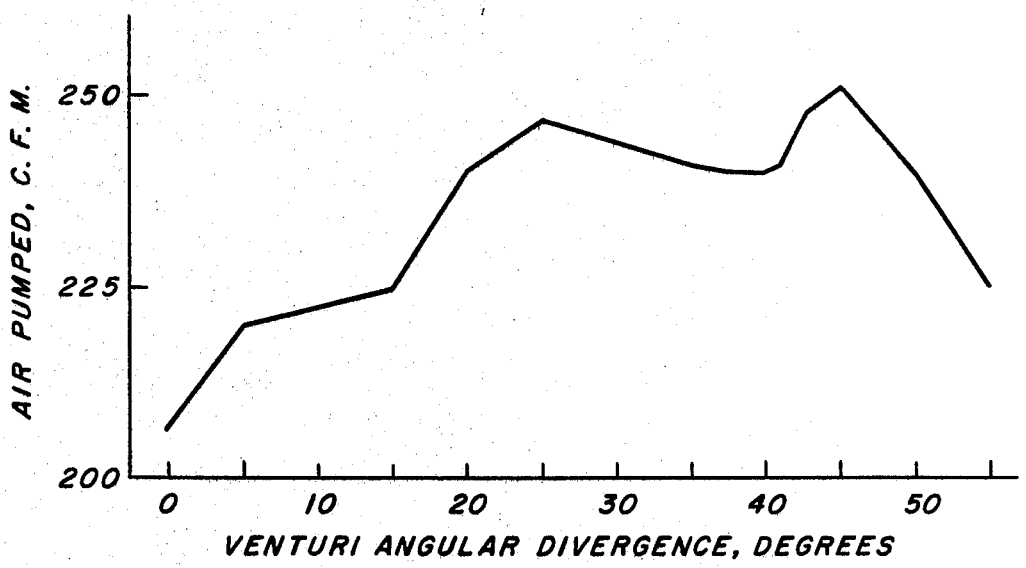
FIG. 7 is a graphic comparison of the effect of angularly changing the exit portion of the preferred embodiment of the air-pumping apparatus to the amount of air pumped therethrough.

As noted above, and as shown in FIG. 7, maximized air pumping occurred at approximately 45° of wall divergence ($\theta = 22.5$) for a nozzle having an angle of divergence $\gamma$ equal to approximately 60° ($2\theta = 3/2$). Slight variations in each angular measurement were tolerated without appreciable changes in the quantity of air pumped. Accordingly, tolerances in the range of ±2° would be reasonable and should be expected.

The rectangular or "low profile" design just described is particularly useful when mounted upon and used in conjunction with coal mining machines operated in shallow coat seams where vertical space is at an absolute premium. However, both the circular and rectangular designs provide for maximized air pumping when utilizing solid cone spray nozzles having cross-sectional configuration which are similar to the cross-sectional interiors of the air-pumping apparatus with which they are employed. The water-powered air-pumping apparatus of the present invention have been specifically configured to pump the maximum amount of air, to atomize the water spray for dust suppression and to provide for adequate coverage of the coal face.

It is expected that continued placement of the air-pumping apparatus upon coal mining machines for methane dilution and coal dust suppression will provide the opportunity to eliminate interferences and delays to operations hindered by methane and coat dust liberation as well as make mines environmentally safer places to work in.

While certain changes may be made in the above system and apparatus without departing from the scope of the invention herein involved, it is intended that all matter contained in the above description or shown in the accompanying drawings shall be interpreted as illustrative and not in a limiting sense.

We claim:

1. Fluid-driven air-pumping and mixing apparatus for mixing and diluting impurities in the air with a fluid, said apparatus comprising:

a housing including means defining a longitudinal passage therethrough, said passage defining means being configured having an inlet at one end thereof co-axially located relative to said longitudinal passage, through which air and impurities may enter said housing, and an outlet at the other end, for permitting the exit of the mixed and diluted impurity-air-fluid mixture from said housing, said passage defining means proximate said outlet being configured having substantially linearly arranged diverging interior wall segments for defining a mixing chamber; and a fluid-dispersing air-driving nozzle, said air-driving nozzle being configured to disperse a solid cone of such fluid outwardly toward said outlet, said nozzle being positioned centrally within said passage co-axially with respect to said passage and being of a size substantially smaller than said passage for permitting the passage of such air and impurities entering through said inlet to pass thereby, said nozzle having an angle of fluid divergence greater than the angle of divergence of said interior wall segments relative to said longitudinal axis, said nozzle being located substantially along the longitudinal axis of said passage such that the outer portion of its divergent fluid cone impinges on said divergent interior wall segments no further backstream than the beginning of the divergence of said interior wall segments, thereby maximizing the air flow through said passage and outwardly through said outlet as well as mixing such impurities in said mixing chamber with the air and with such fluid.

2. In combination with a continuous underground coal mining machine, said machine creating dust and permitting the localized buildup of methane gas entrapped within an unmined coal seam, and a water driven air-pumping apparatus mounted upon said machine for suppressing such dust and diluting such methane gas with air, said air-pumping apparatus comprising:

an elongated housing including means defining a longitudinally oriented passage therethrough, said passage defining means being configured having an inlet at one end thereof co-axially located relative to said longitudinally oriented passage, through which air and dust may enter said housing, and an outlet, at the other end of said passage, directed toward the area of localized gas, for permitting the exit of such dust, air and water from said housing, said passage defining means proximate said outlet being configured having substantially linearly arranged diverging interior wall segments for defining a mixing chamber; and a water dispersing air-driving nozzle, said air-driving nozzle being configured to disperse a solid cone of water outwardly toward said outlet, said nozzle being positioned centrally within said passage co-axially with respect to said passage and being of a size substantially smaller than said passage for permitting the passage of such air and impurities entering through said inlet to pass thereby, said nozzle having an angle of water divergence greater than the angle of divergence of said interior wall segments relative to said longitudinal axis, said nozzle being located substantially along the longitudinal axis of said passage such that the outer portion of its divergent water cone impinges on said divergent interior wall segments no further backstream than the beginning of the divergence of said interior wall segments, thereby maximizing the air flow through said passage and out of said outlet toward such gas for diluting such gas for a given water pressure at said nozzle as well as mixing such dust in said mixing chamber with such water.

3. The air-pumping apparatus of the combination according to claim 2 in which said passage defining means is further configured to define a passage having a circular cross section, such section being taken through a plane normal to such longitudinal axis of said passage, said nozzle having an optimum angle of dispersion of approximately twice that of said angle of divergence of said interior wall segments for maximizing the air flow through said passage for a given water pressure at said nozzle.

4. The air-pumping apparatus of the combination according to claim 2 in which said passage defining means is further configured to define a passage having a circular cross section at least through said mixing chamber, such section being taken through a plane normal to such longitudinal axis of said passage, said nozzle having an angle of dispersion of approximately 50° while the total angle of divergence of said interior wall segments is in the range of between 20° and 25° for producing a maximized air flow rate through said passage for a given water pressure at said nozzle.

5. The air-pumping apparatus of the combination according to claim 2 in which said passage defining means is further configured to define a passage having a rectangular cross section at least through said mixing chamber, such section being taken through a plane normal to such longitudinal axis of said passage, said nozzle having an angle of dispersion of approximately one and one-half times that of said angle of divergence of said interior wall segments, whereby the air flow through said passage for a given water pressure at said nozzle is maximized.

6. The air-pumping apparatus of the combination according to claim 2 in which said passage defining means is further configured to define a passage having a rectangular cross section at least through said mixing chamber, such section being taken through a plane normal to such longitudinal axis of said passage, said nozzle having an angle of dispersion of approximately 60° while the total angle of divergence of only one pair of the two pair of interior wall segments is approximately 45°, the remaining pair of interior wall segments not being divergent, for producing a maximized air flow rate through said passage for a given water pressure at said nozzle.

7. Water driven air-pumping apparatus for suppressing dust and pumping air, said apparatus comprising:

a housing including means defining a passage therethrough, said passage defining means being configured having an inlet at one end thereof co-axially located relative to said longitudinal passage, through which air and dust may enter said housing, and an outlet at the other end, for permitting the exit of the mixed dust-water and air mixture from said housing, said means defining said passage being further configured such that a cross section taken therethrough along a longitudinal axis extending between said inlet and said outlet is a right angle parallelogram, said passage defining means at least proximate said outlet being configured having at least one pair of substantially linearly arranged oppositely-oriented interior walls being divergent for defining a mixing chamber; and a water-dispersing air-driving nozzle, said air-driving nozzle being configured to disperse a pyramidal-shaped solid cone of water outwardly toward said outlet, said solid cone water configuration being substantially geometrically similar to such right angle parallelogram cross section at any point along such longitudinal axis, said nozzle being positioned centrally within said passage co-axially with respect to said passage and being of a size substantially smaller than said passage for permitting the passage of such air and impurities entering through said inlet to pass thereby, said nozzle having an angle of water divergence greater than the angle of divergence of said at least one pair of oppositely-oriented interior walls, said nozzle being located being located substantially on the longitudinal axis of said passage such that the outer portion of its solid cone of divergent water impinges on all four of the interior walls no further backstream than the beginning of the divergence of said at least one pair of oppositely-oriented interior walls, thereby maximizing the air flow through said passage, mixing such dust in said mixing chamber with the water, and minimizing the space requirements of said air-pumping apparatus with a given air and water flow.

8. The water driven air-pumping apparatus according to claim 7 in which only one pair of oppositely-oriented interior walls are divergent, the other pair being oriented parallel to each other, said nozzle having an angle of dispersion of approximately 60° while the total angle of divergence of said only one pair of divergent interior walls being approximately 45°, whereby the air flow through said passage and outward through said outlet and the mixing of such dust with such water is maximized for a given water pressure at said nozzle.

9. In combination with a continuous underground coal mining machine, said machine creating dust and permitting the localized buildup of methane gas entrapped within an unmined coal seam, a water driven air-pumping apparatus mounted upon said mining machine, for suppressing such dust and diluting such methane gas with air, said air-pumping apparatus comprising:

an elongated housing including means defining a longitudinally-oriented passage extending therethrough, said passage defining means being configured having an inlet at one end thereof co-axially located relative to said longitudinally-oriented passage, through which air and dust may enter said housing, and an outlet at the other end, directable toward the area of localized gas buildup, for permitting the exit of such dust, air and water from said housing, said passage defining means being further configured such that a cross section taken therethrough along a longitudinal axis extending between said inlet and said outlet is a right angle parallelogram, said passage defining means proximate at least said outlet being configured having at least one pair of oppositely-oriented substantially linearly-arranged interior walls being divergent toward said outlet for defining a mixing chamber; and a water-dispersing and air-driving nozzle, said air-driving nozzle being configured to dispose a pyramidal-shaped solid cone of water outwardly toward said outlet, the solid cone water configuration being substantially geometrically similar to such right angle parallelogram cross section at any point along such longitudinal axis, said nozzle being positioned centrally within said passage coaxially with respect to said passage and being of a size substantially smaller than said passage for permitting the passage of such air and impurities entering through said inlet to pass thereby, said nozzle having an angle of water dispersion greater than the angle of divergence of said at least one pair of oppositely-oriented interior walls, said nozzle being located substantially on the longitudinal axis of said passage such that the outer portion of its solid cone of divergent water impinges on all four of the interior walls no further backstream than the beginning of the divergence of said at least one pair of oppositely-oriented interior walls, thereby maximizing the air flow through said passage and out of said outlet toward such methane gas for diluting such gas, as well as mixing such dust in said mixing chamber with such water, and minimizing the space requirements of said air pumping apparatus with a given air and water flow.

10. The water driven air-pumping apparatus of the combination according to claim 9 in which only one pair of oppositely-oriented interior walls are divergent, the other pair being oriented parallel to each other, said nozzle having an angle of dispersion of approximately 60° while the total angle of divergence of said only one pair of divergent interior walls being approximately 45°, whereby the air flow through said passage and outward through said outlet and the mixing of such dust with such water is maximized for a given water pressure at said nozzle.

* * * * *

UNITED STATES PATENT OFFICE

CERTIFICATE OF CORRECTION

Patent No. 4,084,855 Dated April 18, 1978

Inventor(s) Roscoe C. Miles, Joseph Subrick and Woods G. Talman

It is certified that error appears in the above-identified patent and that said Letters Patent are hereby corrected as shown below:

Col. 7, line 58, change "coat" to -- coal --.

Col. 7, line 62, change "configuration" to -- configurations --.

Col. 10, line 34, before "substantially", delete -- being located --.

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*